US009970070B2

(12) United States Patent
Li et al.

(10) Patent No.: US 9,970,070 B2
(45) Date of Patent: May 15, 2018

(54) CHROME-FREE LEATHER RETANNING

(71) Applicant: Rohm and Haas Company, Philadelphia, PA (US)

(72) Inventors: Caiyun Li, Shanghai (CN); Fengyi Su, Shanghai (CN); Yin Xue, Shanghai (CN)

(73) Assignee: Rohm and Haas Company, Philadelphia, PA (US)

( * ) Notice: Subject to any disclaimer, the term of this patent is extended or adjusted under 35 U.S.C. 154(b) by 477 days.

(21) Appl. No.: 14/514,582

(22) Filed: Oct. 15, 2014

(65) Prior Publication Data

US 2015/0107028 A1 Apr. 23, 2015

(30) Foreign Application Priority Data

Oct. 18, 2013 (CN) ..... 2013 1 0492704

(51) Int. Cl.

| | |
|---|---|
| ***C14C 3/16*** | (2006.01) |
| ***C14C 3/22*** | (2006.01) |
| ***C14C 3/24*** | (2006.01) |
| ***C14C 3/26*** | (2006.01) |
| ***C14C 3/28*** | (2006.01) |

(52) U.S. Cl.

CPC ..... *C14C 3/22* (2013.01); *C14C 3/16* (2013.01); *C14C 3/26* (2013.01); *C14C 3/28* (2013.01)

(58) Field of Classification Search

CPC .... C08K 5/00; C08K 5/52; C08K 9/04; C08L 23/00

USPC ..... 8/94.15; 252/606; 524/100

See application file for complete search history.

(56) References Cited

U.S. PATENT DOCUMENTS

| | | | | |
|---|---|---|---|---|
| 4,384,056 | A | 5/1983 | Schmidt et al. | |
| 4,539,361 | A | 9/1985 | Siol et al. | |
| 4,599,375 | A | 7/1986 | Berte' et al. | |
| 7,449,577 | B2 | 11/2008 | Kimura et al. | |
| 7,465,761 | B2 | 12/2008 | Murase et al. | |
| 7,638,576 | B2 | 12/2009 | Devonport et al. | |
| 2004/0036061 | A1* | 2/2004 | Rhodes et al. | 252/606 |
| 2005/0229324 | A1* | 10/2005 | Fennen et al. | 8/94.15 |
| 2009/0300848 | A1 | 12/2009 | Booth et al. | |
| 2010/0249286 | A1* | 9/2010 | Yamaki et al. | 524/100 |
| 2014/0123399 | A1 | 5/2014 | Reiners et al. | |

FOREIGN PATENT DOCUMENTS

| | | | |
|---|---|---|---|
| DE | 243046 | B1 | 4/1989 |
| EP | 1719800 | A1 | 11/2006 |
| EP | 2194091 | A1 | 6/2010 |

* cited by examiner

*Primary Examiner* — Gregory R Delcotto
*Assistant Examiner* — Preeti Kumar
(74) *Attorney, Agent, or Firm* — Karl E. Stauss; Ronald D. Bakule

(57) ABSTRACT

A method for forming chrome-free retanned leather including: (a) contacting wet white with from 1% to 8%, by solids weight, based on the wet weight of wet white, retanning agent selected from the group consisting of: i) an aqueous emulsion polymer including, as copolymerized units, from 2% to 35%, by weight, based on the weight of the emulsion polymer, ethylenically-unsaturated monomer bearing at least one epoxy group, the emulsion polymer having a weight average molecular weight of from 2,000 to 100,000; ii) a compound selected from the group comprising piperazine, piperazine hydrates, salts of piperazine, and combinations thereof; and iii) combinations of i) and ii); (b) heating the contacted wet white; and (c) drying the contacted, heated wet white is provided. The present application also relates to chrome-free retanned leather formed by the method of the invention.

4 Claims, No Drawings

CHROME-FREE LEATHER RETANNING

This invention relates to chrome-free leather retanning. More particularly this invention relates to a method for forming chrome-free retanned leather including: (a) contacting wet white (chrome-free tanned hide) with from 1% to 8%, by solids weight, based on the wet weight of wet white, retanning agent selected from the group consisting of: i) an aqueous emulsion polymer including, as copolymerized units, from 2% to 35%, by weight, based on the weight of the emulsion polymer, ethylenically-unsaturated monomer bearing at least one epoxy group, the emulsion polymer having a weight average molecular weight of from 2,000 to 100,000; ii) a compound selected from the group comprising piperazine, piperazine hydrates, salts of piperazine, and combinations thereof; and iii) combinations of i) and ii); (b) heating the contacted wet white; and (c) drying the contacted, heated wet white. The present application also relates to chrome-free retanned leather formed by the method.

The treatment of hides and skins to make leather involves a number of interdependent chemical and mechanical operations. These operations may be divided into a sequence of wet end steps, i.e., process steps under wet conditions, followed by a sequence of dry steps, i.e., process steps under dry conditions. A typical leather making process involves the following sequence of wet-end steps: trimming and sorting, soaking, fleshing, unhairing, baiting, pickling, tanning, wringing, splitting and shaving, retanning, coloring, fatliquoring and setting out. These wet-end steps are followed by a sequence of dry steps, such as, drying, conditioning, staking, buffing, finishing, plating, measuring and grading. A description of each of these operations is provided in Leather Facts, New England Tanners (1972).

The present invention is involved with a wet-end step that takes place after primary tanning; namely retanning. The object of primary tanning is to convert the hide, pelt or skin to a stable non-spoilable material. After primary tanning, the leather is retanned. Chrome-free tanned skins/hides, referred to herein as "wet white", may be retanned by using a variety of naturally derived materials including extracts from vegetables or plants, and synthetic tanning agents known as "syntans", or combinations thereof. After retanning or, if desired, during retanning, the hide is colored with colorants, such as, acid dyes, mordant dyes, direct dyes, metalized dyes, soluble sulfur dyes, and cationic dyes.

The leather tanning industry is searching for alternative treatments to produce chrome-free tanned leathers. By "chrome-free" herein is meant that the leather is free from the element Chromium in any of its oxidation states in any of its compounds; chrome-free does not exclude de minimus levels of chromium, levels such as may be consistent with legislative or regulatory definitions of chrome-free. The wet-white leathers require particular retanning agents on account of the different chemistries employed. Retanning agents for chrome-free tanned leather are required in order to provide leathers with good softness and dye intensity.

U.S. Pat. No. 7,638,576 discloses multi-stage aqueous dispersions of polymeric particles bearing epoxy groups for coating compositions.

U.S. Pat. No. 7,465,761 discloses flame retardant compositions for polymeric resins including salts of piperazine.

Journal of the Society of Leather technologists and Chemists, 90, pp 93-101, 2006 discloses the use of epoxide-containing small molecules, i.e., molecules having a molecular weight of less than 500 to tan leather to increase shrink temperatures. However, such leather is relatively stiff.

Improvement in the softness and dye intensity of chrome-free leather is still sought and is provided by the method of the present invention via the retanning step in leather production.

In a first aspect of the present invention there is provided a method for forming chrome-free retanned leather comprising contacting wet white with from 1% to 8%, by solids weight, based on the wet weight of wet white, retanning agent selected from the group consisting of; i) an aqueous emulsion polymer comprising, as copolymerized units, from 2% to 35%, by weight, based on the weight of said emulsion polymer, ethylenically-unsaturated monomer bearing at least one epoxy group, said emulsion polymer having a weight average molecular weight of from 2,000 to 100,000; ii) a compound selected from the group comprising piperazine, piperazine hydrates, salts of piperazine, and combinations thereof; and iii) combinations of i) and ii).

In a second aspect of the present invention there is provided chrome-free retanned leather formed by the method of the first aspect of the present invention.

In the method of the present invention wet white is contacted with from 1% to 8%, preferably from 3% to 6%, by solids weight, based on the wet weight of wet white, retanning agent selected from the group consisting of; a) an aqueous emulsion polymer including, as copolymerized units, from 2% to 35%, by weight, based on the weight of the emulsion polymer, ethylenically-unsaturated monomer bearing at least one epoxy group, the emulsion polymer having a weight average molecular weight of from 2,000 to 100,000; b) a compound selected from the group consisting of piperazine, piperazine hydrates, salts of piperazine, and combinations thereof; and c) combinations of a) and b).

The aqueous emulsion polymer retanning agent is formed by addition polymerization under emulsion polymerization conditions and includes, as copolymerized units, from 2% to 50%, preferably from 2% to 35%, and more preferably from 5% to 30%, by weight, based on the weight of said emulsion polymer, ethylenically-unsaturated monomer bearing at least one epoxy group. The ethylenically-unsaturated monomer bearing at least one epoxy group includes, for example, glycidyl (meth)acrylate, allyl glycidyl ether, glycidyl cinnamates, glycidyl crotonates, glycidyl itaconates, glycidyl norbornenyl ester, glycidyl norbornenyl ether, and the like. Preferred are glycidyl (meth)acrylate and allyl glycidyl ether The aqueous emulsion polymer further includes as copolymerized units, at least one unsaturated monomer such as monoethylenically unsaturated monomers including styrene, vinyltoluene, ethylene, vinyl acetate, vinyl chloride, vinylidene chloride, acrylonitrile, (meth)acrylamide, various ($C_1$-$C_{20}$) alkyl or ($C_3$-$C_{20}$) alkenyl esters of (meth)acrylic acid, including methyl acrylate (MA), methyl methacrylate (MMA), ethyl (meth)acrylate, butyl (meth)acrylate, 2-hydroxyethyl (meth)acrylate, 2-ethylhexyl (meth)acrylate, benzyl (meth)acrylate, lauryl (meth)acrylate, oleyl (meth) acrylate, palmityl (meth)acrylate, and stearyl (meth)acrylate. The use of the term "(meth)" followed by another term such as (meth)acrylate or (meth)acrylamide, as used throughout the disclosure, refers to both acrylates or acrylamides and methacrylates and methacrylamides, respectively. The emulsion polymer is typically "substantially uncrosslinked" by which is meant herein that the emulsion polymer includes, as copolymerized units, from 0% to 0.1%, preferably 0%, by weight of crosslinking monomers such as, for example, diethylenically unsaturated monomer such as, for example allyl (meth)acrylate, vinyl (meth)acrylate, methallyl (meth)acrylate, diallyl phthalate, 1,4-butylene glycol di(meth)acrylate, 1,2-ethylene glycol di(meth)acrylate, 1,6-hexanediol di(meth)acrylate, and divinyl benzene. Low levels of adventitious crosslinking as might be engendered during the formation, storage, and handling of the emulsion polymer, however, are not precluded.

Preferably, the aqueous emulsion polymer is a water-based acrylic copolymer, i.e., a copolymer including a predominant amount of copolymerized (meth)acrylic esters, and including from 0% to 5%, preferably from 0.1% to 0.25%, by weight, as copolymerized units, monomer bearing carboxylic acid or hydroxy functionality, or mixtures thereof.

The calculated glass transition temperature ("Tg") of the emulsion polymer is typically from −80° C. to −20° C., preferably from −80° C. to −40° C., arrived at by selection of the monomers and amounts of the monomers to achieve the desired polymer Tg, as is well known in the art. Tgs of the polymers are calculated herein by using the Fox equation (T. G. Fox, Bull. Am. Physics Soc., Volume 1, Issue No. 3, page 123 (1956)), that is, for calculating the Tg of a copolymer of monomers M1 and M2, $$1/Tg(calc.)=w(M1)/Tg(M1)+w(M2)/Tg(M2),$$

wherein

Tg(calc.) is the glass transition temperature calculated for the copolymer w(M1) is the weight fraction of monomer M1 in the copolymer w(M2) is the weight fraction of monomer M2 in the copolymer Tg(M1) is the glass transition temperature of the homopolymer of M1

Tg(M2) is the glass transition temperature of the homopolymer of M2, all temperatures being in K.

The glass transition temperature of homopolymers may be found, for example, in "Polymer Handbook", edited by J. Brandrup and E. H. Immergut, Interscience Publishers. In embodiments where two or more different emulsion polymers or emulsion polymers including multiple phases such as, for example, core/shell polymers are used then the calculated Tg of the emulsion polymer shall be calculated based on the overall composition of the polymeric components.

The weight average molecular weight of the aqueous emulsion polymer is from 2,000 to 100,000, preferably from 4,000 to 40,000, as measured by Gel Permeation Chromatography using polystyrene standards.

The aqueous emulsion polymer is formed by an addition polymerization under emulsion polymerization conditions as is well known in the art. Conventional surfactants and blends may be used including, for example, anionic and/or nonionic emulsifiers such as, for example, alkali metal or ammonium alkyl sulfates, alkyl sulfonic acids, fatty acids, and oxyethylated alkyl phenols, and mixtures thereof. Polymerizable surfactants that include at least one ethylenically unsaturated carbon-carbon bond which can undergo free radical addition polymerization may be used. The amount of surfactant used is usually 0.1% to 6% by weight, based on the weight of total monomer. Either thermal or redox initiation processes may be used. Conventional free radical initiators may be used such as, for example, hydrogen peroxide, t-butyl hydroperoxide, t-amyl hydroperoxide, ammonium and/or alkali persulfates, typically at a level of 0.01% to 3.0% by weight, based on the weight of total monomer. Redox systems using the same initiators coupled with a suitable reductant such as, for example, sodium sulfoxylate formaldehyde, sodium hydrosulfite, isoascorbic acid, hydroxylamine sulfate and sodium bisulfite may be used at similar levels, optionally in combination with metal ions such as, for example iron and copper, optionally further including complexing agents for the metal. Chain transfer agents such as, for example, mercaptans may be used to control the molecular weight of the polymer. Typically, levels of from 0.1% to 5%, by weight, based on the weight of total monomer of mercaptans selected from alkyl mercaptans and mercaptoalkyl carboxylic acid esters are used. The monomer mixture may be added neat or as an emulsion in water. The monomer mixture may be added in a single addition or more additions or continuously over the reaction period using a uniform or varying composition. Additional ingredients such as, for example, free radical initiators, oxidants, reducing agents, chain transfer agents, neutralizers, surfactants, and dispersants may be added prior to, during, or subsequent to the monomer addition. Processes yielding polymodal particle size distributions such as those disclosed in U.S. Pat. Nos. 4,384,056 and 4,539,361, for example, may be employed. The emulsion polymer may be formed in a multi-stage emulsion polymerization process as are well known in the art. The emulsion polymer is also contemplated to be formed in two or more stages, the stages differing in molecular weight. Blending two different emulsion polymers is also contemplated.

The aqueous emulsion polymer particles typically have a number average diameter of from 100 nm to 1500 nm, preferably from 100 nm to 600 nm, as measured by light scattering.

The retanning agent compounds of the method of the present invention are selected from the group consisting of piperazine, piperazine hydrates, salts of piperazine, and combinations thereof. Piperazine may be formed by reacting alcoholic ammonia with 1,2-dichloroethan, by the action of sodium and ethylene glycol on ethylenediamine hydrochloride, or by reduction of pyrazine with sodium in ethanol. Piperazine hydrates include piperazine hexahydrate. Salts of piperazine include, for example, piperazine citrate, piperazine adipate, piperazinephosphate, piperazine pyrophosphate, piperazine orthophosphate and piperazine polyphosphate. A preferred retanning agent is a mixture of piperazine orthophosphate and piperazine pyrophosphate in a ratio of from 5:1 to 1:5, preferably of from 2:1 to 1:2.

Retanning agents that are a mixture of the aqueous emulsion polymer described hereinabove and the retanning agent compound described hereinabove typically include from 10% to 50%, preferably from 20% to 40%, by weight retanning agent compound based on the dry weight of the aqueous emulsion polymer.

Other chemicals may be incorporated with the retanning agent compositions to confer certain performance properties. The other chemicals may include, independently, fatliquoring agents, pigment(s), emulsifiers, surfactants, lubricants, coalescing agents, antifreezes, curing agents, buffers, neutralizers, thickeners, rheology modifiers, humectants, wetting agents, biocides, plasticizers, antifoaming agents, UV absorbers, fluorescent brighteners, light or heat stabilizers, biocides, chelating agents, dispersants, colorants, dyes, water-repellants, and anti-oxidants.

In a typical retanning process the hides are heated for a certain time in contact with the retanning agent for a sufficient time to effect reaction, and then dried to produce the retanned leather. Typically, the contacted wet white were drummed for from 30 min to 600 min at 25° C. to 60° C., and then dried for 24 hr at ambient temperature.

The invention in some of its embodiments will now be further described by reference to the following examples:

| Chemical/Brand Name | Supplier | Abbreviation |
|---|---|---|
| TRITON ™ X-405 | | X-405 |
| TERGITOL ™ 15-s-40 (70%) | | 15-s-40 |
| Experimental EH-40 (70%) | | EH-40 |
| Butylated Hydroxytoluene | Sinopharm Chemical Reagent Co., Ltd | BHT |
| Butyl Acrylate | Plant | BA |
| 2-ethylhexyl Acrylate | Plant | EHA |
| Glycidyl Methacrylate | Tokyo Chemical Industry | GMA |
| Methyl 3-Mercaptopropionate | Tokyo Chemical Industry | MMP |
| n-Dodecyl Mercaptan | Plant | nDDM |
| Iron (II) Sulfate | Sinopharm Chemical Reagent Co., Ltd | |
| Ethylene Diamine Tetraacetic Acid | Sinopharm Chemical Reagent Co., Ltd | EDTA |
| t-Butyl hydroperoxide (70%) | | t-BHP |
| BRUGGOLITE ™ FF6 | | FF6 |
| LEUKOTAN ™ 1084 | DOW Chemical Co., Ltd. | |
| PREVENTOL ™ WB Plus-L | Lanxess Chemical Co., Ltd. | |
| BAYGENAL ™ Brown CGG I | Lanxess Chemical Co., Ltd. | |
| BAYKANOL ™ Licker SL | Lanxess Chemical Co., Ltd. | |
| BAYKANOL ™ Licker Additive L | Lanxess Chemical Co., Ltd. | |
| EUREKA ™ 950-R | Atlas Refinery Inc. | |
| LEVOTAN ™ GTA-C | Lanxess Chemical Co., Ltd. | |
| TANIGAN ™ CK | Bayer Chemical Co., Ltd. | |
| TANIGAN ™ PAK | Lanxess Chemical Co., Ltd. | |
| TANIGAN ™ BN | Lanxess Chemical Co., Ltd. | |
| TANIGAN ™ F | Lanxess Chemical Co., Ltd. | |
| Seta TR | Seta S/A - Sociedade | |
| Sodium Pyrosulfite | Sinopharm Chemical Reagent Co., Ltd. | |
| Sodium Bicarbonate | Shanghai Hongguang Chemical Co., Ltd. | |
| Oxalic Acid Dihydrate | Sinopharm Chemical Reagent Co., Ltd. | |
| Sodium Formate Dihydrate | Sinopharm Chemical Reagent Co., Ltd. | |
| Formic Acid | Sinopharm Chemical Reagent Co., Ltd. | |
| EDTA (Ethylene Diamine Tetraacetic Acid) | Sinopharm Chemical Reagent Co., Ltd. | |

Leather Processing

Procedure I is a primary tanning process used to treat pickled bovine pelts with a thickness of 1.8-2.2 mm. purchased from Jiangyin Lexus Trading Co., Ltd. (Jiangsu, China) to make wet whites. The tanning agent was a type of modified glutaraldehyde (LEVOTAN™ GTA-C). Procedure II was used to evaluate the selected samples retanning performance on wet whites.

All weights were based on the weight of the leather stock (100% means a weight equal to the weight of the stock put into the drum). All chemical addition percentages refer to their weight % based on the weight of the leather stock, unless specially stated.

Procedure I 1) 50% float (float refers to water; 100% float means the addition of a weight of water equal to the stock weight) was added into a drum with about 4% sodium salt to obtain a solution with 7° Bé (Baume degrees) at 20° C.
2) To this was added a pelt, tumbled in the drum for 10 minutes. Then 0.3% PREVENTOL™ WB Plus-L was added for 5 minutes, followed by 1% BAYKANOL™ Licker SL for 20 minutes and 3% LEVOTAN™ GTA-C for 30 minutes. All the three chemicals were diluted fourfold with water before their adding into the drum.
3) To this was added 3% TANIGAN™ CK, drummed for 180 minutes.
4) To this was added 0.3% $Na_2S_2O_5$ running for 10 minutes. Then the float pH was increased to approximately 3.9 by gradually adding the total 0.75-1.5% usage of sodium bicarbonate with 0.5% and/or 0.25% portions per once as needed. After 75-90 minutes, 100% float was added and the drum temperature was increased to 40° C., drummed for 60 minutes.
5) The stock was hauled out from the drum and horsed (piled on a wooden horse) overnight at room temperature.
6) On the following day, after checking the shrink temperature (Ts), the stock was set out and then shaved to 1.0-1.2 mm.
7) The stock was washed with the 200% water and 0.2% oxalic acid at 35° C. for 20 minutes. Then the drum was drained.
8) 100% fresh float was offered with 2% TANIGAN PAK to the stock at 35° C. for 10 minutes.
9) The stock was neutralized with 1.5% sodium formate and 0.5-1.5% sodium bicarbonate to get the float pH to around 4.9, tumbled for 30-40 minutes.
10) To this was added 3% EUREKA™ 950-R diluted with triplex water, tumbled for 30 minutes. 3% LEUKOTAN™ 1084 and 8% TANIGAN BN were followed added for 20 minutes. 4% TANIGAN™ F was added following for 30 minutes tumbling.
11) To this was added 12% Seta TR for 120 minutes. 50% float was added and the drum temperature was increased to 40° C. for 10 minutes.
12) To this was added 3% EUREKA™ 950-R diluted with triplex water, drummed for 90 minutes.
13) Formic acid was added to the contents of the tanning drum at a level of 0.5 weight % formic acid (85% active). 10-15% of formic acid was added into the drum to lower the float pH to less than 3.8, continually drummed for 30-60 minutes at room temperature.
14) The drum was drained. 200% fresh float was added with 0.2% EDTA to wash the stock at room temperature for 30 minutes.
15) The treated stock was horsed overnight. On the following day, it was hung on the toggle to be semi-dried.

Procedure II

The stocks treated by Procedure I were re-weighed. The chemical addition percentage refers to their weight % based on the weight of the treated stocks.

1) The tanned stock was offered with 400% float and 0.6% oxalic acid at 35° C. The stock was tumbled at least for 60 minutes until it was totally wet back (the water inside the stock was saturated and the stock became soft). Then the drum was drained.
2) The stock and an added 200% float were neutralized with 1.0% sodium formate and 1.5-1.75% sodium bicarbonate. The mixture was then drummed for more than 3 hours. The pH of the neutralization float was monitored and maintained in the range of 5.0-5.5 by offering sodium bicarbonate to the leather in 0.5% and/or 0.25% portions per addition as needed.
3) After neutralization, the drum temperature raised to 45° C. and the selected sample was added as 3% or 6% solids (the added solids weight of sample was 3% or 6% based on the stock weight), drummed for 90-120 minutes.
4) 2% BAYGENAL™ Brown CGG I (dyestuff) was offered to the stock at 40° C. for 30-60 minutes.
5) 4% BAYKANOL™ Licker Additive L was offered to the stock at 45° C. for 60-90 minutes.
6) Formic acid was added to the contents of the tanning drum at a level of 0.5 weight % formic acid (85% active). The formic acid was added as 10-25% into the drum to lower the float pH to less than 3.6, continually drummed for 30-60 minutes at room temperature.

7) The treated stock was horsed overnight. On the following day, it was hung on the toggle to be dried.

After Procedure I and II, the moisture content of the frame-dried treated stock (called crust) was adjusted to 16-19% by spraying it uniformly with water and sealing it in a plastic bag for 4-24 hours (called conditioning). The resulting conditioned leather was then mechanically softened by a process called staking to provide the suitable leather samples for further testing or evaluation.

Test/Evaluation Methods

Particle size was determined by BrookHaven BI-90 Plus, dynamic light scattering.

Molecular weights were determined by gel permeation chromatography.

Float Clarity

Float clarity was evaluated by visual inspection (observation) of the float turbidity excluding the influence of leather debris inside, to indicate the chemical uptake degree by the leather fibers.

Dye Shade/Coloring Results

Dyeing intensity result is evaluated by visual inspection of the treated leather with the emphasis on the hue (relative to the expected "true color") and the vividness (lack of grayness, whiteness, or bleaching) on grain. The color is rated on a scale of very good, good, fair, and poor.

Touch

Touch was evaluated by hand feeling on the grain surface with different description including dry, smooth, draggy/moist, and natural.

Softness

The Softness (BLC) testing method is ISO 17235-2002: Leather—Physical and mechanical tests—Determination of softness. The results are expressed with numbers and mm as units.

For Softness (handling), Softness crusts were rated by manual handling/feeling, on a scale of the very soft, soft, fair, slightly firm, firm.

Synthesis of Sample 1

Monomer Emulsion—40 g X-405 (70%) was dissolved in 400 g deionized water (DI water). An emulsified monomer mixture was prepared by adding the following chemicals slowly to the agitated solution: 0.7 g BHT, 665 g BA, 35 g GMA, 21 g MMP.

A solution containing 5 g X-405 (70%) and 650 g deionized water ("DI water" herein) were placed in a 5-necked, 3 liter round bottom flask equipped with a thermocouple, a cooling condenser and an agitator, and heated to 65° C. under nitrogen. Transferred 116.2 g monomer emulsion into the flask, and added 1.5 g iron (II) sulfate (0.5% solution) and 1.5 g ethylene diamine tetraacetic acid (0.5% solution, EDTA). When the temperature was at 65° C., added the redox initiator couple that consisted of a solution of 70%, t-BHP (0.15 g in 10 g DI water) and a solution of FF6 (0.13 g in 10 g DI water). Within about 5 minutes, initiation of polymerization was confirmed by the increase of temperature by about 5~10° C. and change of the external appearance of the reaction mixture. After the generation of heat had ended, the remainder of the Monomer Emulsion and the redox couple consisted of a solution of t-BHP (70%, 1.88 g in 55 g DI water) and a solution of FF6 (0.85 g in 55 g DI water) were added gradually to the flask with stirring over a period of 120 minutes. The polymerization reaction temperature was maintained at 64-66° C. After completing the addition, the vessel that contained the Monomer Emulsion and the feeding pipes leading into the flask were rinsed with 60 g DI water, and the rinse was added back to the flask. Upon completion of the additions the reaction mixture was cooled to 60° C. before gradual addition of t-BHP (70%, 1.53 g in 13 g water) and FF6 (0.71 g in 15 g water) over 30 minutes, with stirring. Upon completion of the feeds, the reaction was cooled to room temperature.

Synthesis of Samples 2-10 and Comparative Samples a-b

The syntheses were carried out according to the method presented above with varying monomer emulsions as presented below:

Sample 2 Monomer Emulsion—40 g X-405 (70%) was dissolved in 400 g DI water. An emulsified monomer mixture was prepared by adding the following chemicals slowly to the agitated solution: 0.7 g BHT, 332.5 g 2-ethyhexyl acrylate (EHA), 332.5 g BA, 35 g GMA, 21 g MMP.

Sample 3 Monomer Emulsion—40 g X-405 (70%) was dissolved in 400 g DI water. An emulsified monomer mixture was prepared by adding the following chemicals slowly to the agitated solution: 0.7 g BHT, 665 g EHA, 35 g GMA, 21 g MMP.

Sample 4 Monomer Emulsion—40 g X-405 (70%) was dissolved in 400 g DI water. An emulsified monomer mixture was prepared by adding the following chemicals slowly to the agitated solution: 0.7 g BHT, 665 g EHA, 35 g GMA, 35 g n-dodecyl mercaptan (nDDM).

Sample 5 Monomer Emulsion—36 g Experimental EH-40 (70%, EH-40) was dissolved in 300 g DI water. An emulsified monomer mixture was prepared by adding the following chemicals slowly to the agitated solution: 0.7 g BHT, 630 g EHA, 70 g GMA, 35 g MMP.

Sample 6 Monomer Emulsion—36 g EH-40 (70%) was dissolved in 300 g DI water. An emulsified monomer mixture was prepared by adding the following chemicals slowly to the agitated solution: 0.7 g BHT, 560 g EHA, 140 g GMA, 35 g MMP.

Sample 7 Monomer Emulsion—36 g EH-40 (70%) was dissolved in 300 g DI water. An emulsified monomer mixture was prepared by adding the following chemicals slowly to the agitated solution: 0.7 g BHT, 455 g EHA, 245 g GMA, 35 g MMP.

Comparative Sample a Monomer Emulsion—40 g X-405 (70%) was dissolved in 400 g DI water. An emulsified monomer mixture was prepared by adding the following chemicals slowly to the agitated solution: 0.7 g BHT, 700 g EHA, 21 g MMP.

Comparative Sample b Monomer Emulsion—36 g EH-40 (70%) was dissolved in 400 g DI water. An emulsified monomer mixture was prepared by adding the following chemicals slowly to the agitated solution: 0.7 g BHT, 700 g EHA, 35 g MMP.

EXAMPLES 1-7 and COMPARATIVE EXAMPLES A-B

Test Results

TABLE 1.1

Emulsion polymer samples used in evaluation

| Sample ID | Composition | Weight Average Molecular Weight |
|---|---|---|
| Sample 1 | 95BA/5GMA/3MMP | 34000 |
| Sample 2 | 47.5EHA/47.5BA/5GMA/3MMP | 12500 |
| Sample 3 | 95EHA/5GMA/3MMP | 7300 |

TABLE 1.1-continued

| Emulsion polymer samples used in evaluation | | |
|---|---|---|
| Sample ID | Composition | Weight Average Molecular Weight |
| Sample 4 | 95EHA/5GMA/5nddm | 21500 |
| Sample 5 | 90EHA/10GMA/5MMP | 5900 |
| Sample 6 | 80EHA/20GMA/5MMP | 8000 |
| Sample 7 | 65EHA/35GMA/5MMP | 12400 |
| Comparative Sample a | 100EHA/3MMP | 6700 |
| Comparative Sample b | 100EHA/5MMP | 4300 |

Note: Sample 1 is the emulsion polymer used in Example 1; Sample 2 is the emulsion polymer used in Example 2, etc. Comparative Sample a is the emulsion polymer used in Comparative Example A and Comparative Sample b is the emulsion polymer used in Comparative Example B.

TABLE 1.2

| Dye Delivery Evaluation | | | |
|---|---|---|---|
| Sample ID | Composition | Usage | Coloring Results |
| Blank | | | 3rd best brown hue, slightly bleached - fair color |
| Example 1 | 95BA/5GMA/3MMP | 3% | 2nd best brown hue, less vivid - good color |
| Example 2 | 47.5EHA/47.5BA/5GMA/3MMP | 3% | 2nd best brown hue, less vivid - good color |
| Example 3 | 95EHA/5GMA/3MMP | 3% | The best brown hue, vivid - good color |

There is no significant difference on color expression when changing the composition of copolymerized (meth) acrylic ester from BA to EHA.

TABLE 1.3

| Dye Delivery Evaluation | | | |
|---|---|---|---|
| Sample ID | Composition | Usage | Coloring Results |
| Blank | | | 5th best brown hue, bleached to pastel - fair color |
| Example 4 | 95EHA/5GMA/5nddm | 3% | 4th best brown hue, slightly bleached - good color |
| Example 5 | 90EHA/10GMA/5MMP | 3% | 2nd best brown hue, less vivid - good color |
| Example 6 | 80EHA/20GMA/5MMP | 3% | 3rd best brown hue, slightly bleached - good color |
| Example 6' | 80EHA/20GMA/5MMP | 6% | The best brown hue, vivid - very good color |

Increasing usage of inventive polymer benefits the color expression (Example 6 vs Example 6'), while there is not much effect of the GMA level from 5 to 20 weight %.

TABLE 1.4

| Dye Delivery Evaluation | | | |
|---|---|---|---|
| Sample ID | Composition | Usage | Coloring Results |
| Blank | | | 3rd best brown hue, bleached to pastel - fair color |
| Example 3 | 95EHA/5GMA/3MMP | 3% | The best brown hue, vivid - good color |
| Comparative Example A | 100EHA/3MMP | 3% | 2nd best brown hue, less vivid - good color |

TABLE 1.4-continued

| Dye Delivery Evaluation | | | |
|---|---|---|---|
| Sample ID | Composition | Usage | Coloring Results |
| Example 5 | 90EHA/10GMA/5MMP | 3% | The best brown hue, vivid - good color |
| Example 6 | 80EHA/20GMA/5MMP | 3% | The best brown hue, vivid - good color |
| Example 7 | 65EHA/35GMA/5MMP | 3% | 2nd best brown hue, slightly bleached - fair color |
| Comparative Example B | 100EHA/5MMP | 3% | 2nd best brown hue, slightly bleached - fair color |

GMA in the emulsion polymer provides the leather better color expression than the emulsion polymer without GMA. When the GMA level is too high (>35%), the effect may be lessened.

TABLE 1.5

| Uptake of Emulsion Polymers | | | |
|---|---|---|---|
| Sample ID | Composition | Usage | Float Clarity & Color |
| Blank | | | Semi-turbid, yellow |
| Example 3 | 95EHA/5GMA/3MMP | 3% | Semi-turbid, yellow |
| Comparative Example A | 100EHA/3MMP | 3% | Turbid, milky white |

The GMA-containing polymer exhibits an improved uptake by chrome-free leathers, thus showing a less turbid float.

TABLE 1.6

| Touch Evaluation | | | |
|---|---|---|---|
| Sample ID | Composition | Usage | Touch |
| Blank | | | Slightly dry, smooth |
| Example 4 | 95EHA/5GMA/5nddm | 3% | Natural |
| Example 5 | 90EHA/10GMA/5MMP | 3% | Slightly draggy |
| Example 6 | 80EHA/20GMA/5MMP | 3% | Slightly draggy |
| Example 6' | 80EHA/20GMA/5MMP | 6% | Draggy |

Increasing the GMA level or the level of GMA-containing emulsion polymer usage improves the grain surface touch by increasing the humid feeling.

EXAMPLE 8

Formation and Evaluation of Chrome-Free Retanned Leather

A retanning agent compound, piperazine (AR) mixture, was added to wet white leather in a retanning process at 45° C. for 90 minutes. The materials were added as 3% (solids %) to wet white hides (taking the hide weight as 100%). The hides were drummed for 90 minutes, and then dried for 24 hr and the properties were assessed through hand feel or instrument testing. Table 8.1 shows the final properties of each hide.

TABLE 8.1

| Evaluation of chrome-free retanned leather | | |
|---|---|---|
| Properties (test method) | Comparative Example B (No retanning agent) | Example 8 |
| Softness (BLC) | 4.0 | 4.3 |
| Softness (handling) | soft | Very soft |
| Dye intensity (inspection) | $3^{rd}$ best brown hue; slightly bleached-fair color | $3^{rd}$ best brown hue; slightly bleached-fair color |

For BLC softness, higher values indicate softer leather. Note: The dye intensity for Examples 8 and 9 were rated relative to each other.

Piperazine (AR) mixture is a 1.0/0.8, on a molar basis, mixture of piperazine phosphate and piperazine pyrophosphate.

Example 8 of the invention affords improved softness compared with the Comparative Example.

EXAMPLE 9

Formation and Evaluation of Chrome-Free Retanned Leather

For Example 9, the aqueous emulsion polymer, Sample 3, was blended with piperazine (AR) mixture as 2:1 (solids). A 3% (solids %) blend mixture was added to the wet white hides (taking the hide weight as 100%) in the leather retanning process. The conditions were similar to those used in Example 8. Table 9.1 shows the final properties of each hide.

TABLE 9.1

| Evaluation of chrome-free retanned leather | | |
|---|---|---|
| Properties (test method) | Comparative Example C (No retanning agent) | Example 9 |
| Softness (BLC) | 3.4 | 3.5 |
| Softness (handling) | Fair | Very soft |
| Dye intensity (inspection) | $2^{nd}$ best brown hue; slightly bleached-fair color | Best brown hue, less vivid-good color |

For BLC softness, higher values indicate softer leather. Note: The dye intensity for Examples 8 and 9 were rated relative to each other.

The use of piperazine mixture along with the aqueous emulsion copolymer (Example 9 of the invention) provided leathers with better softness (hand feel) and dye intensity (visual inspection) compared with the Comparative Example.

We claim:

1. A method for forming chrome-free retanned leather comprising:

(a) contacting wet white with from 1% to 8%, by solids weight, based on the wet weight of wet white, retanning agent selected from the group consisting of: i) an aqueous emulsion polymer comprising, as copolymerized units, from 2% to 35%, by weight, based on the weight of said emulsion polymer, ethylenically-unsaturated monomer bearing at least one epoxy group, said emulsion polymer having a weight average molecular weight of from 2,000 to 100,000;

ii) a compound selected from the group comprising piperazine, piperazine hydrates, salts of piperazine, and combinations thereof; and iii) combinations of i) and ii);

(b) heating said contacted wet white; and (c) drying said contacted, heated wet white.

2. The method of claim 1 wherein said ethylenically-unsaturated monomer bearing at least one epoxy group is selected from the group consisting of glycidyl (meth)acrylate, allyl glycidyl ether, and mixtures thereof.

3. The method of claim 1 wherein said compound is a mixture of piperazine phosphate and piperazine pyrophosphate.

4. A chrome-free retanned leather formed by the method of claim 1.

* * * * *